US006263573B1

(12) United States Patent
Bullard

(10) Patent No.: US 6,263,573 B1
(45) Date of Patent: Jul. 24, 2001

(54) SEATING PRODUCT WITH SINUOUS SPRING ASSEMBLIES

(75) Inventor: Larry I. Bullard, Winston-Salem, NC (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/585,853

(22) Filed: Jun. 1, 2000

Related U.S. Application Data

(62) Division of application No. 09/243,868, filed on Feb. 3, 1999, now Pat. No. 6,116,694.

(51) Int. Cl.[7] ..... B21F 35/00
(52) U.S. Cl. ..... 29/896.92; 29/450
(58) Field of Search ..... 29/896.92, 896.9, 29/450, 91.1, 91.5

(56) References Cited

U.S. PATENT DOCUMENTS

| | | | | |
|---|---|---|---|---|
| 2,234,253 | | 3/1941 | Hopkes . | |
| 3,039,763 | | 6/1962 | Staples et al. . | |
| 3,170,220 | * | 11/1996 | Doerer | 29/896.92 |
| 3,170,221 | * | 2/1965 | Doerer | 29/896.92 |
| 3,210,064 | | 10/1965 | Crosby . | |
| 3,311,366 | | 3/1967 | Crosby . | |
| 3,527,499 | | 9/1970 | Rathbun et al. . | |
| 4,157,172 | | 6/1979 | Crosby . | |
| 4,458,943 | | 7/1984 | Krakauer . | |
| 5,570,874 | * | 11/1996 | Tornero | 29/896.92 |

* cited by examiner

*Primary Examiner*—Anthony D. Barfield
(74) *Attorney, Agent, or Firm*—Wood, Herron & Evans, LLP

(57) ABSTRACT

A seating product comprising a plurality of sinuous spring assemblies secured at opposite ends to a frame. Each of the sinuous spring assemblies comprises length of webbing having a pair of opposed end portions which are secured to the frame and a sinuous spring. The length of webbing is intertwined with the sinuous spring. The sinuous spring is secured at opposite ends to the length of webbing. Padding and an upholstered covering complete the seating product.

5 Claims, 3 Drawing Sheets

SEATING PRODUCT WITH SINUOUS SPRING ASSEMBLIES

CROSS REFERENCE TO RELATED APPLICATIONS

This application is a divisional application of U.S. patent application Ser. No. 09/243,868 filed Feb. 3, 1999 now U.S. Pat. No. 6,116,694, entitled SEATING PRODUCT WITH SINUOUS SPRING ASSEMBLIES which is fully incorporated by reference herein.

FIELD OF THE INVENTION

This invention relates to furniture products, and more particularly to seating products and the like which employ sinuous springs rather than the traditional coil springs to form the interior core of the product.

BACKGROUND OF THE INVENTION

Seating products or the like which employ sinuous springs are known. Usually the seating product is divided into a back section which supports the back of a person sitting on the product and a seat section upon which the user sits. Either section may comprise a generally rectangular wooden frame made up of four orthogonal rails, typically made of wood, and a plurality of sinuous springs extending between a pair of opposed rails of the frame. In order to secure the sinuous springs to the opposed rails of the frame, generally clips are secured to the top surfaces of the opposed rails at spaced intervals in order to space the parallel sinuous springs. The endmost segments or portions of the sinuous springs are inserted into the clips in order to secure the sinuous springs to the opposed rails of the frame. Due to the inherent stiffness of the sinuous springs, the sinuous springs are commonly arched or domed so as to provide a softer, more comfortable "feel" for the user. Even with arched or arcuate sinuous springs, if the sinuous springs are secured directly to the frame by metal clips or other conventional securements, the seating product generally has a relatively "hard," less-than-desirable seating surface because of the firmness of the sinuous springs.

In order to increase the softness or give of either the back or seat section of a seating product employing sinuous springs, several different types of connectors connecting the endmost segments of the sinuous springs to the frame have been employed. U.S. Pat. No. 4,157,173 discloses rail connectors in the form of torsion springs connecting the endmost segments of the sinuous springs to clips secured to the rails of the seating product. Similarly, U.S. Pat. Nos. 3,210,064 and 3,311,366 disclose coiled springs extending between and secured to the endmost segments of the sinuous springs and the clips secured to the frame in order to increase the resiliency of the sinuous springs. When any of these types of connectors are used to secure the endmost segments of the sinuous springs to the frame, the endmost segments of the sinuous springs may be moved inwardly from the opposed rails of the frame, thus increasing the resiliency or softness of product.

The use of clips to secure the sinuous springs or connecting elements to the frame often requires that the frame be made of a relatively hard wood product such as oak or maple, because the clips must be nailed or stapled in place securely in order to support the load placed on the sinuous springs. Such hardwood frames present a drawback to the manufacture of sinuous wire seating products because of the expense of the hardwood material from which the frame must be made.

An additional drawback to using clips to secure the endmost segments of the sinuous springs to the frame is that often the interaction between the endmost segments of the sinuous springs and the clips creates unwanted noise due to the movement of the endmost segments of the sinuous springs inside the clips secured to the frame.

Another type of seating or furniture product uses a plurality of webbing strips rather than sinuous springs extending between opposed rails of the frame in order provide the supporting surface of the product. Such a construction is most commonly used on outdoor seating furniture. This type of construction does not provide a comfortable seating or back surface for the user, primarily because the webbing lacks sufficient resiliency or give once a load is placed on the webbing.

Regardless of whether a seating product employs arched sinuous springs or lengths of webbing to make the body of the product, the resiliency of the product is generally uniform or symmetrical. Oftentimes, it is desirable to increase the firmness of a particular portion of a seating product. For example, in the back section of a seating product, an increased firmness in the lower portion of the back section may be desirable in order to provide lumbar or lower back support.

Therefore, it has been one objective of the present invention to provide a seating product which does not employ clips in order to secure the endmost segments of arched sinuous wire springs to the frame of the seating product.

It has further been an objective of the present invention to provide a seating product which does not require the use of hardwoods for the frame of the seating product.

It has been a further objective of the present invention to provide a seating product in which sinuous wire springs may be secured to lengths of webbing in different locations in order to provide lower back or lumbar support for the user of the seating product.

SUMMARY OF THE INVENTION

The seating product of the present invention comprises a frame having a front rail, a rear rail and a pair of opposed side rails. The frame is commonly made of wood, but may be made of any other type of material including fiberboard or plywood. A plurality of sinuous spring assemblies are secured to a pair of opposed rails of the frame with fasteners. Padding covers the top surface of the sinuous spring assemblies, and an upholstered covering encases the frame, the padding and the sinuous spring assemblies.

Each of the sinuous spring assemblies comprises a length of webbing intertwined with a sinuous spring. The sinuous spring has a plurality of spaced linear segments joined by arcuate connecting segments. The length of webbing passes over and under spaced linear segments of the sinuous spring. The endmost segments of the sinuous spring may be secured to the length of webbing in any number of ways including inserting the endmost segments of the sinuous springs in loops integrally formed in the length of webbing. Depending on the location of the loops relative to the length of webbing, the sinuous spring may be secured at any number of locations on the length of webbing.

Each length of webbing has two opposed end portions which are not intertwined with the sinuous spring and which extend beyond the ends of sinuous spring. These end portions of the length of webbing may be the same length or of differing lengths. These end portions of the length of webbing pass over the top surface of the frame and are stapled or otherwise secured to the frame with fasteners.

The sinuous springs may be of any length and may be secured at differing locations on the length of webbing. In a back section of a seating product the sinuous springs may be secured toward the lower portions of the lengths of webbing in order to create an arcuate or curved lumbar or lower back support. In the same manner, either the seat or back section of a seating product may be customized for a particular use or for a particular individual.

These objects and advantages will be more apparent from the following description of the drawings.

DETAILED DESCRIPTION OF THE DRAWINGS

Figure 1:
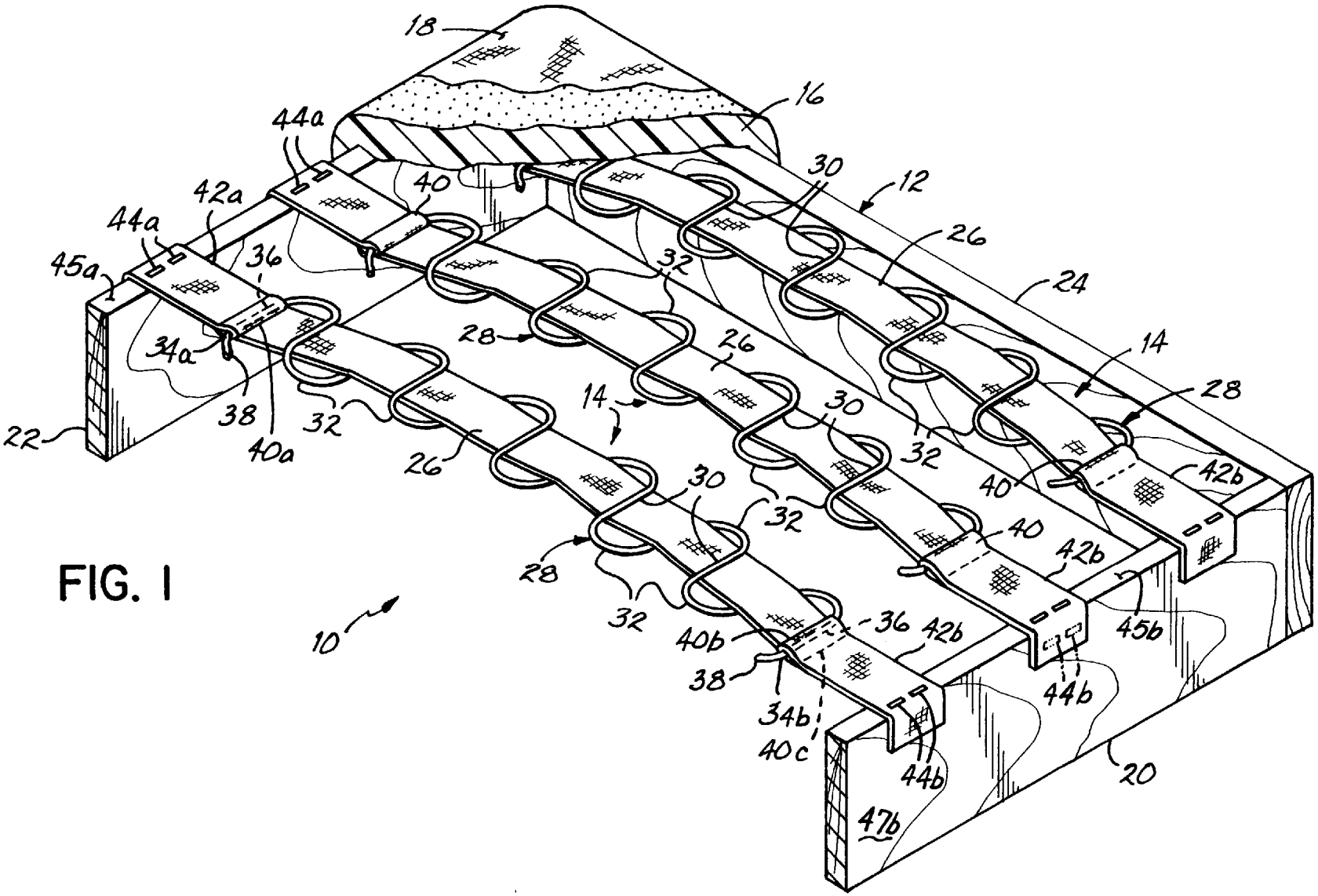
FIG. 1 is a perspective view partially cut away of a seating product of the present invention.

Referring to the drawings, and particularly to FIG. 1, there is illustrated a seating product 10. The seating product 10 may comprise either a seat section or a back section of a seating product or any other component of furniture. The seating product 10 comprises a frame designated generally 12 and a series of sinuous spring assemblies 14 secured to the frame. One or more layers of padding 16 may cover one or more surfaces of the seating product. An upholstered covering 18 encases or surrounds the frame 12, the sinuous spring assemblies 14 and the padding 16.

Referring to FIG. 1, the frame 12 comprises a front rail 20, a rear rail 22 and pair of opposed side rails 24 (only one being shown). The front and rear rails 20,22 comprise a pair opposed rails, and likewise the side rails comprise a pair of opposed rails.

A plurality of parallel sinuous spring assemblies 14 are illustrated in FIG. 1 as extending between the front rail 20 and the rear rail 22 of the frame, i.e., from front to back. However, the sinuous spring assemblies 14 could extend between the side rails 24 of the frame 12 as well.

Although FIG. 1 illustrates a seat section of a piece of furniture, the seating product 10 could just as well comprise the back section of a piece of furniture or any other component.

Each sinuous spring assembly 14 comprises a length or strap of fabric webbing 26 and a sinuous spring 28. The sinuous spring 28 comprises a plurality of spaced linear segments 30 interconnected by alternating (on opposite sides) arcuate connecting segments 32. The connecting segments 32 are illustrated as being semicircular but may have other configurations as well. The length of fabric webbing 26 passes over and under adjacent spaced linear segments of the sinuous spring 28 in order to intertwine the length of webbing 26 and sinuous spring. Alternatively, the length of fabric webbing 26 may pass over and under multiple linear segments 30 of the sinuous wire spring 28.

The sinuous spring 28 has a pair of end segments 34*a* and 34*b*. These end segments may be entirely linear or, as shown in FIG. 1, may comprise a linear section 36 and tail section 38. The tail section 38 helps to maintain the end segments 34*a*,34*b* inside loops 40*a*,40*b* formed in the length of webbing. The loops 40*a*,40*b* may be integrally formed in the webbing by a sewn line of stitching 40*c* or may be separate pieces of fabric joined or sewn to the length of webbing 26 at the desired locations. Alternatively, the endmost segments 34*a*,34*b* or any other portion of the sinuous spring 28 may be secured to the length of webbing 26 by hog rings, staples or any other type of fastener or connection. The loops 40*a*,40*b* may be located anywhere along the length of the webbing 26 depending upon the length of the webbing, length of the sinuous spring and the desired location of the sinuous spring relative to the frame.

The length of webbing 26 has a pair of opposed end portions 42*a* and 42*b*. The endmost portion 42*a* is illustrated as being secured to the rear rail 22 with fasteners 44*a* and the end portion 42*b* being secured to the front rail 20 with fasteners 44*b*.

Figure 2:
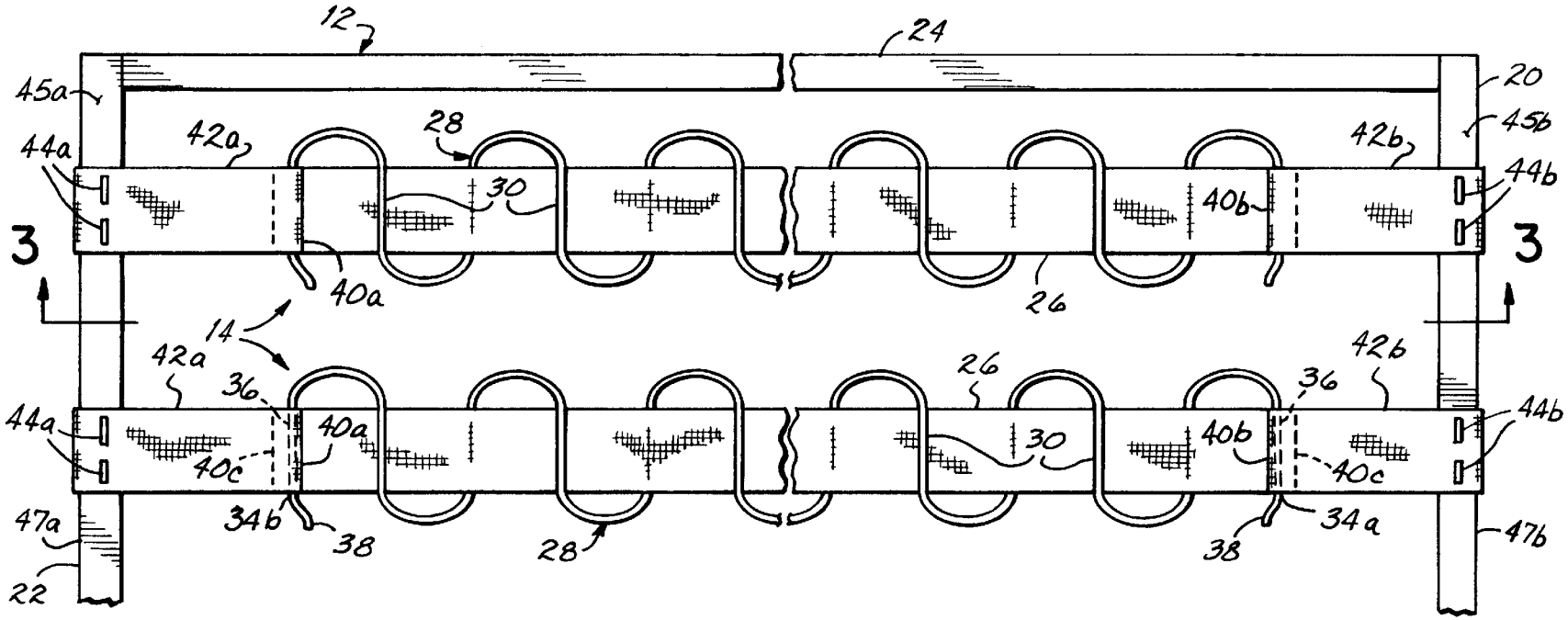
FIG. 2 is a top plan view of a portion of the seating product of FIG. 1.

Referring to FIG. 2, the end portions 42*a* and 42*b* of the lengths or straps of webbing are illustrated as being an identical length in order to fix the location of the sinuous spring in the middle of the interior of the frame, thus creating a symmetrical surface. However, one of the end portions of the length of webbing may be longer than the other end portion of the same length of webbing depending upon the desired location of the sinuous spring relative to the frame.

Figure 3:
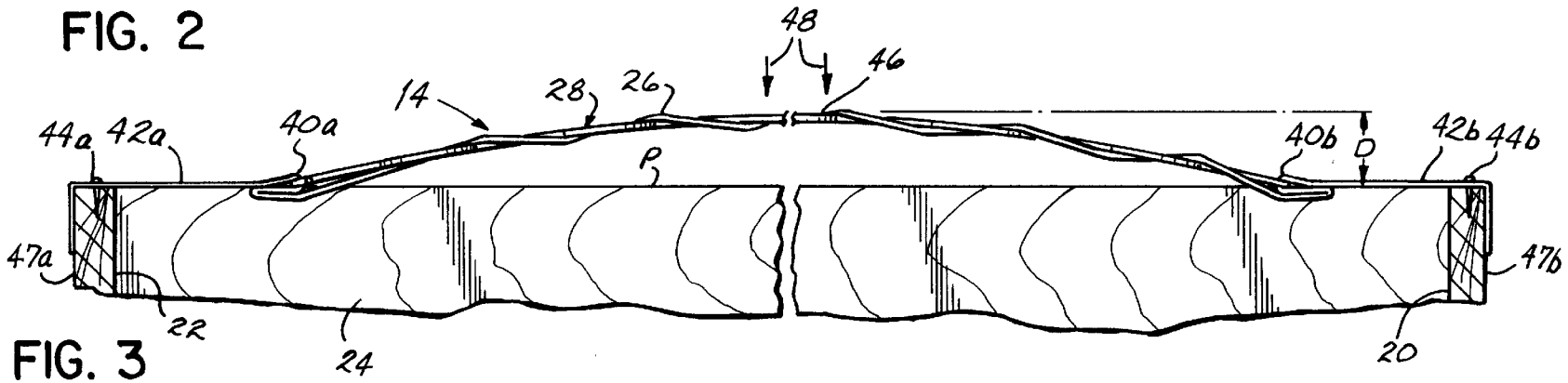
FIG. 3 is a cross-sectional view taken along the line 3—3 of FIG. 2.

As illustrated in FIGS. 1–3, the fasteners 44*a* and 44*b* pass through the end portions 42*a*,42*b*, respectively, of the length of webbing and into the interior of a pair of opposed rails of the frame through the top surfaces 45*a*,45*b* of the frame rails 20,22 as the frame is oriented in FIG. 1. Alternatively or additionally, the fasteners 44*a* and 44*b* may pass through the end portions 42*a*,42*b* of the length of fabric webbing 26 and into the side surfaces 47*a*,47*b* of the pair of opposed rails (see phantom lines in FIG. 1).

Referring to FIG. 3, each of the sinuous springs 28 is arcuate or arched so that the uppermost point or crown 46 of the sinuous spring 28 extends a distance D above a plane P defined by the end portions 42*a*,42*b* of the length of webbing 26 intertwined with the sinuous spring 28. Thus, when a load is placed downwardly upon the sinuous spring assemblies 14 in the direction of arrows 48, the crown 46 of the sinuous wire spring 28 will be pushed downwardly slightly, thus creating a yielding or soft sensation to the user.

Figure 4:
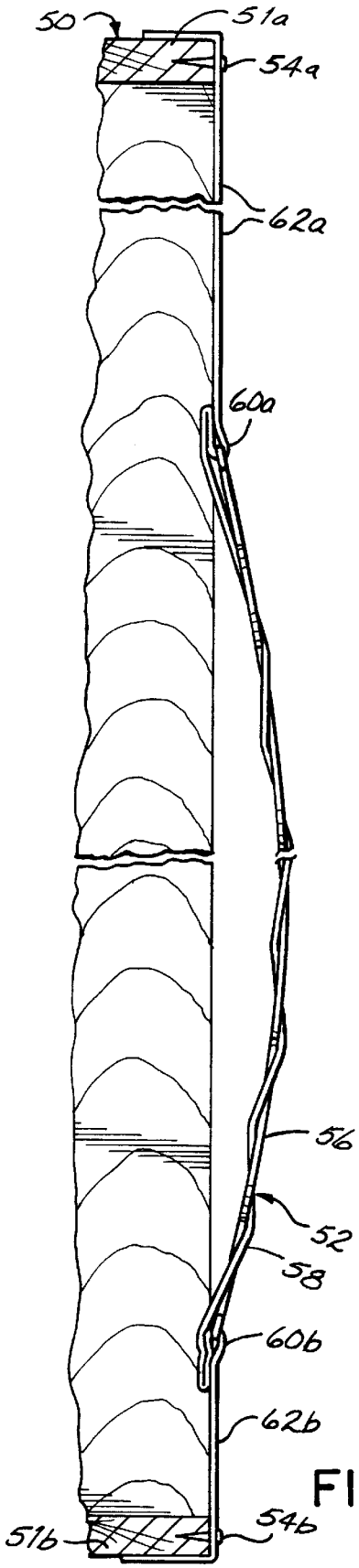
FIG. 4 is a side elevational view of a back section of a seating product made in accordance with the present invention.

Referring to FIG. 4, there is illustrated a seating product used as the back section of a seat. A pair of opposed rails 51*a* and 51*b* of frame 50 are oriented so that rail 51*a* is above rail 51*b*. A plurality of sinuous spring assemblies 52 are secured to the opposed rails 51*a*, 51*b* by fasteners 54*a*, 54*b*, as described hereinabove. The sinuous spring assembly 52 has a sinuous spring 56 and a length of webbing 58 intertwined in the manner described hereinabove. However, the loops 60*a*, 60*b* are integrally formed in the length of webbing 58 in positions such that the sinuous spring 56 is located toward the bottom or lower part of the length of webbing. The endmost segments of the sinuous spring 56 are inserted into the loops, as has been described hereinabove, in order to fix the location of the sinuous wire spring 56 relative to the length of webbing 58 and relative to the frame 50. The position of the loops 60*a*,60*b* oriented toward the bottom of the assembly 52 increases the distance of the end portion 62*a* secured to the rail 51*a* and decreases the length of the end portion 62*b* secured to the rail 51*b*. With the sinuous spring assemblies 52 oriented downwardly toward the lower portion of the back section of the seating product, the user may enjoy an arcuate lumbar or lower back support. In the same manner, the sinuous spring may be moved upwardly to accommodate a different user who desires an increased firmness or support in a different location of a back section of the seating product. Thus, a seating product made in accordance with the present invention may be customized in order to fit a particular user.

The length or straps of webbing of the present invention may be made of any number of woven or nonwoven fabric materials. One preferred type of webbing material is a polyester material trademarked "SYTEX®", manufactured by the MATREX® division of Leggett & Platt, Incorporated. A second alternative type of webbing material suitable, and in some instances preferred for this application is a woven polypropylene material containing rubber or elastomeric filaments. However, these are just two of any number of materials which may be used for the webbing material of the present invention.

In order to assemble one of the seating products in accordance with the present invention, one must first provide a frame having at least a pair of opposite side walls. A plurality of sinuous spring assemblies must then be assembled by intertwining a length of webbing with a sinuous spring and connecting the end segments of the sinuous spring to the length of webbing at the desired locations by inserting the endmost segments into loops integrally formed in the length of webbing. Alternatively, the end segments of the sinuous spring may be connected to the webbing by any other method or type of conventional connector. Using fasteners such a staples, one end portion of the length of webbing is secured to one of the opposed rails of the frame. The sinuous spring assembly is then stretched across the frame, and the opposite end portion of the length of webbing is secured to the other of the opposed rails of the frame. One after another of these sinuous spring assemblies is secured in this fashion to the opposed rails of the frame before the padding and upholstered covering are applied in order to complete the assembly of the product.

Although I have described several preferred embodiments of my invention, I do not intend to be limited except by the scope of the following claims. For example, different types of connections may secure a sinuous spring to a length of webbing without requiring loops in the length of webbing. Therefore, I do not intend to be limited except by the scope of the following claims.

I claim:

1. A method of assembling a seating product comprising:

providing a frame having two opposed rails, making a plurality of sinuous spring assemblies by intertwining lengths of webbing with a plurality of sinuous springs, such that said lengths of webbing pass over and under spaced linear segments of said sinuous springs, and securing said sinuous spring assemblies to said frame by securing opposite end portions of said length of webbing to said opposed rails of said frame.

2. The method of claim 1 wherein securing said sinuous spring assembly to said frame comprises fastening said end portions of said lengths of webbing to said opposed rails of said frame with fasteners.

3. The method of claim 1 further comprising securing said lengths of webbing and said sinuous springs together by placing opposed end segments of said sinuous spring in loops formed in said length of webbing.

4. A method of assembling a seating product comprising:

providing a frame having at least two opposed rails, making a sinuous spring assembly by intertwining a length of webbing with a sinuous spring, such that said length of webbing passes over and under adjacent spaced linear segments of said sinuous spring and securing opposite end segments of said sinuous spring to said length of webbing, securing one end portion of said length of webbing to one of said opposed rails of said frame, stretching said sinuous spring assembly across said frame, and securing an opposite end portion of said length of webbing to the other of said opposed rails of said frame.

5. The method of claim 4 further comprising securing said length of webbing and said sinuous spring by placing opposed end segments of said sinuous spring in loops formed in said length of webbing.

* * * * *